US009580662B1

(12) United States Patent
Moore

(10) Patent No.: US 9,580,662 B1
(45) **Date of Patent: *Feb. 28, 2017**

(54) HYDROPROCESSING

(71) Applicant: Marathon Petroleum Company LP, Findlay, OH (US)

(72) Inventor: Howard F. Moore, Ashland, KY (US)

(73) Assignee: Marathon Petroleum Company LP, Findlay, OH (US)

( * ) Notice: Subject to any disclaimer, the term of this patent is extended or adjusted under 35 U.S.C. 154(b) by 250 days.

This patent is subject to a terminal disclaimer.

(21) Appl. No.: 14/260,681

(22) Filed: Apr. 24, 2014

Related U.S. Application Data

(63) Continuation of application No. 12/283,165, filed on Sep. 10, 2008, now Pat. No. 8,764,970.

(51) Int. Cl.
*C10G 65/02* (2006.01)
*C10G 45/72* (2006.01)

(52) U.S. Cl.
CPC ..... *C10G 45/72* (2013.01)

(58) Field of Classification Search
CPC ..... C10G 45/72
See application file for complete search history.

(56) References Cited

U.S. PATENT DOCUMENTS 5,114,562 A 5/1992 Haun et al.
5,492,617 A * 2/1996 Trimble ..... B01J 8/003 208/113
6,190,535 B1 2/2001 Kalnes et al.
6,451,197 B1 9/2002 Kalnes
6,824,673 B1 * 11/2004 Ellis ..... C10G 65/12 208/15
6,858,128 B1 2/2005 Hoehn et al.
7,291,257 B2 11/2007 Ackerson et al.

* cited by examiner

*Primary Examiner* — Michelle Stein
(74) *Attorney, Agent, or Firm* — Emch, Schaffer, Schaub & Porcello Co., L.P.A.

(57) ABSTRACT

The present invention relates to quenching, during hydroprocessing of a hydrocarbon feed stream. More particularly, the present invention provides for quenching in hydroprocessing of a hydrocarbon feed stream through a hydroprocessing vessel. Liquid quenches (from high pressure hot separator) were installed to assist in cooling the reactor inter-bed, and to maintain good liquid irrigation of the catalyst. The soluble hydrogen in the stream, kinetically active and available for immediate reaction, is the final piece of the puzzle for why this unit runs so well.

6 Claims, 6 Drawing Sheets

Unit 56: Design vs Actual

| | Design | Actual (Median) |
|---|---|---|
| Feed Rate, MBPD | 46 | 54 |
| Coker Naptha, MBPD | 2.3 (5%) | 0 |
| Heavy Cat Naptha, MBPD | 10.0 (225%) | 2.0 (4%) |
| LAGO, MBPD | 7.2 (16%) | 15.0 (28%) |
| LCO, MBPD | 18.0 (39%) | 20.0 (37%) |
| Coker Distillates, MBPD | 8.2 (18%) | 12.0 (22%) |
| LCO Texas City, MBPD | | 5 – 10 (9%) |
| Total Cracked Distillates, MBPD | 26.2 (57%) | 37 (68%) |
| API | 26.3 | 25.8 |
| Sulfur, wt% | 1.36 | 1.35 |
| Nitrogen, ppmw | 665 | 634 |
| Bromine No. | 17 | 23[(1)] |
| Aromatic (UV wt%) | 29.1 | 28.4[(1)] |

[(1)] Estimated from Technical Estimates Feed Composition.

FIG. 4

Unit 56: Design vs Actual (Continued)

| Diesel Product | Design | Actual (Median) |
|---|---|---|
| API | 32.6 | 32.9 |
| Sulfur, ppmw | 10.0 | 6.4 |
| Nitrogen, ppmw | < 1.0 | < 1.0 (~ 0.3) |

FIG. 5

HYDROPROCESSING

CROSS REFERENCE TO RELATED APPLICATIONS

This application is a continuation of application Ser. No. 12/283,165, filed Sep. 10, 2008. The patent application identified above is incorporated here by reference in its entirety to provide continuity of disclosure.

TECHNICAL FIELD

This invention relates to providing available, active hydrogen to a high severity hydrotreating unit which improves unit performance. This invention accomplishes that by recycling liquid from a hot, high pressure separator on the unit.

BACKGROUND OF THE INVENTION

In hydroprocessing, which includes hydrotreating, hydrofinishing, hydrorefining and hydrocracking, a catalyst is used for reacting hydrogen with a petroleum fraction, distillates or resides, for the purpose of saturating or removing sulfur, nitrogen, oxygen, metals or other contaminants, or for molecular weight reduction (cracking). Catalysts having special surface properties are required in order to provide the necessary activity to accomplish the desired reaction(s).

In conventional hydroprocessing it is necessary to transfer hydrogen from a vapor phase into the liquid phase where it will be available to react with a petroleum molecule at the surface of the catalyst. This is accomplished by circulating very large volumes of hydrogen gas and the oil through a catalyst bed. The oil and the hydrogen flow through the bed and the hydrogen is absorbed into a thin film of oil that is distributed over the catalyst. The amount of hydrogen required can be large, 1000 to 5000 SCF/bbl of liquid, the reactors are very large and can operate at severe conditions, from a few hundred psi to as much as 5000 psi, and temperatures from around 400.degree. F.-900.degree.F.

Hydroprocessing or hydrotreatment to remove undersirable components from hydrocarbon feed streams is a well known method of catalytically treating hydrocarbons to increase their commercial value. Hydrocarbon liquid streams, and particularly reduced crude oils, petroleum residua, tar sand bitumen, shale oil or liquefied coal or reclaimed oil, generally contain product contaminants, such as sulfur, and or nitrogen, metals and organo-metallic compounds which tend to deactivate catalyst particles during contact by the feed stream and hydrogen under hydroprocessing conditions. Such hydroprocessing conditions are normally in the range of 212 degree(s) F., to 1200 degree(s) F. (100 degree(s) to 650 degree(s)C.) at pressures of from 20 to 300 atmospheres. Generally such hydroprocessing is in the presence of catalyst containing group VI or VII metals such as platinum, molybdenum, tungsten, nickel, cobalt, etc., in combination with various other metallic element particles of alumina, silica, magnesia and so forth having a high surface to volume ratio. More specifically, catalyst utilized for hydrodemetallation, hydrodesulfurization, hydrodenitrification, hydrocracking, etc., of heavy oils and the like are generally made up of a carrier or base material; such as alumina, silica, silicaalumina, or possibly, crystalline aluminosilicate, with one more promoter(s) or catalytically active metal(s) (or compound(s)) plus trace materials. Typical catalytically active metals utilized are cobalt, molybdenum, nickel and tungsten; however, other metals or compounds could be selected dependent on the application.

Other objects and advantages of the present invention will become apparent to those skilled in the art upon a review of the following detailed description of the preferred embodiments and the accompanying drawings.

SUMMARY OF THE INVENTION

The present invention relates to enhancing hydroprocessing of a hydrocarbon feed stream. More particularly, the present invention provides for quenching in hydroprocessing of a hydrocarbon feed stream through a hydroprocessing vessel and for economically utilizing space within the hydroprocessing vessel over a wide range of processing rates.

I installed liquid quenches (from high pressure hot separator) to assist in cooling the reactor inter-bed, and to maintain good liquid irrigation of the catalyst. The soluble hydrogen in the stream, kinetically active and available for immediate reaction, is the final piece of the puzzle for why this unit runs so well.

A hydroprocessing unit was configured, with 2 reactors/4 beds and liquid quench to beds 3 and 4. The liquid quench is a slipstream from the hot high pressure separator liquid. The liquid is cooled before it's injected to increase the effectiveness of the quench but the for the purpose of this invention either heating or cooling may be practiced depending on the needs of the process. Performance results are shown. We are able to run 46M BPD at 10 ppm sulfur product with a 26API Feedstock and 26MBPD (57%) cracked distillates. We've been able to run 54 M BPD (now 57MBPD) average at 6 ppm sulfur with a feed 0.5API lower with 37 M BPD cracked distillates (68%). Overall, heavier, more cracked feedstocks at higher rates for longer periods of time are achieved. The green line in FIG. 6 is the design deactivation rate and the dark blue line is actual.

BRIEF DESCRIPTION OF THE DRAWINGS

FIG. 1 shows a schematic process flow diagram for the mixing area of the hydrotreater of this invention.

FIG. 2 is a schematic diagram showing the reactor area of the hydrotreater of this invention.

FIG. 3 is a schematic diagram showing the separator area of the hydrogreater of this invention.

FIG. 4 is a performance chart showing actual results of the quenching of this invention.

FIG. 5 also is a performance chart showing actual results.

DETAILED DESCRIPTION OF THE INVENTION

This invention makes possible substantially continous flow of uniformly distributed hydrogen and hydrocarbon liquid across a densely packed catalyst which substantially fills the entire volume of a reactor vessel. The liquid and gas components of the hydrocarbon feed stream flow into the bed of catalyst and a quenching medium, which is preferably a liquid, is injected into the bed of catalyst. Injection of a liquid quench reduces the gas component of the hydrocarbon feed stream while simultaneously increasing the residence time and reducing the liquid velocity of the liquid component of the hydrocarbon feed stream within the substantially packed bed of catalyst. Injection of a liquid quench also increases penetration and contact of the liquid component into and on the surface area of the catalyst while simultaneously decreasing the viscosity of the liquid component.

In another embodiment, the hydroprocessing method comprises the steps of: (a) combining hydrogen and a feed to be treated to form a mixture thereof; (b) providing a first reactor with a substantially packed bed of hydroprocessing catalyst; (c) contacting the mixture with the packed bed in the first reactor; (d) simultaneously injecting a gas quench into the substantially packed bed of hydroprocessing catalyst; and (e) withdrawing treated feed from the first reactor.

The method further comprises the steps of: (f) combining the treated feed from the first reactor with a liquid quench to form a second mixture; (g)

providing a second reactor with a substantially packed bed of hydroprocessing catalyst; (h) contacting the second mixture with the packed bed in the second reactor; (i) withdrawing treated feed from the second reactor.

The method further comprises the step of: (j) combining the second mixture with a gas quench prior to feeding the second mixture to the second reactor.

The method further comprises the step of: (k) simultaneously injecting a liquid quench into the substantially packed bed of hydroprocessing catalyst of the second reactor.

The packed bed of catalyst of the first reactor typically comprises two beds of catalyst and the gas quench is fed to the first reactor between the two beds of catalyst. The packed bed of catalyst of the second reactor also typically comprises two beds of catalyst and the liquid quench is fed to the second reactor between the two beds of catalyst.

In the preferred embodiment the treated feed from the second reactor is fed to a hot separator.

A slipstream then is withdrawn from the hot separator.

A portion of the slipstream is reycled to the second reactor as a liquid quench.

Another portion of the slipstream is collected as stripper product.

In one embodiment, the slipstream is cooled.

Figure 1:
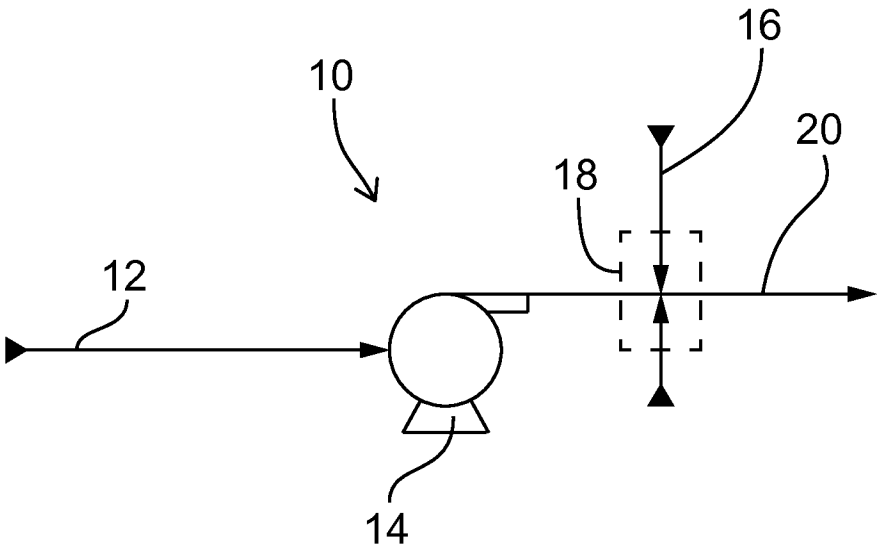
FIGS. 1-3 are flow diagrams for the hydroprocessing of this invention.

FIG. 1 shows a schematic process flow diagram for the mixing area of a hydrotreater generally designated by the numeral 10. Fresh feed stock 12 is pumped by feed charge pump 14 to combination area 18.

Feed stock 12 then is combined with hydrogen 16 to form fresh feed mixture 20.

Figure 2:
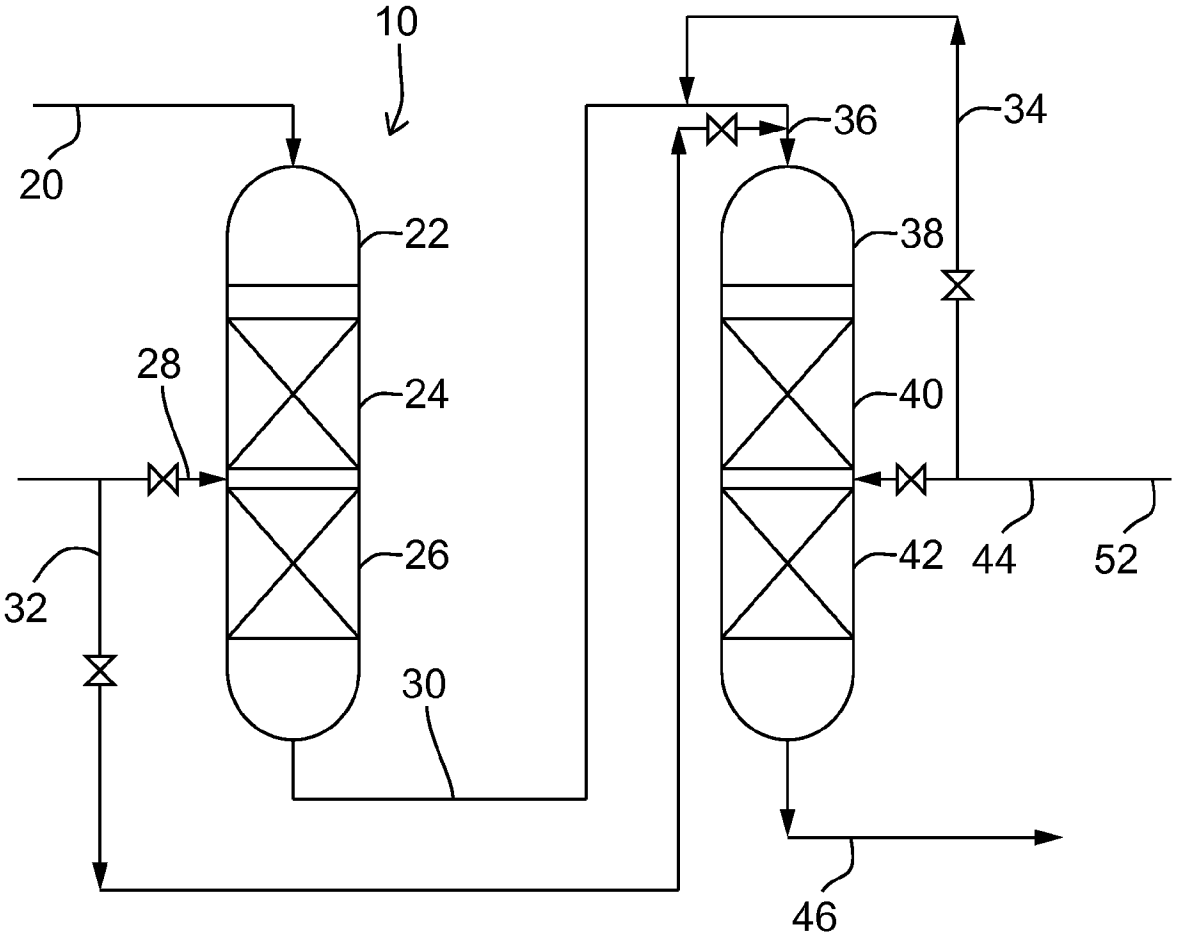

FIG. 2 is a schematic diagram showing the reactor area of hydrotreater 10. Feed mixture 20 is fed into reactor 22. Reactor 22 comprises catalyst bed 24 and catalyst bed 26. Gas quench 28 is fed to reactor 22 between bed 24 and bed 26. Reacted mixture 30 exits reactor 22 beneath bed 25. G as quench 32 and liquid quench 34 are blended with reacted mixture 30 to form mixture 36. mixture 36 then is fed into reactor 38. Reactor 38 comprises catalyst bed 40 and catalyst bed 42. Liquid quench 44 is fed into reactor 38 between bed 40 and bed 42. Reactor effluent 46 is withdrawn from reactor 38 and sent to a hot separator.

Figure 3:
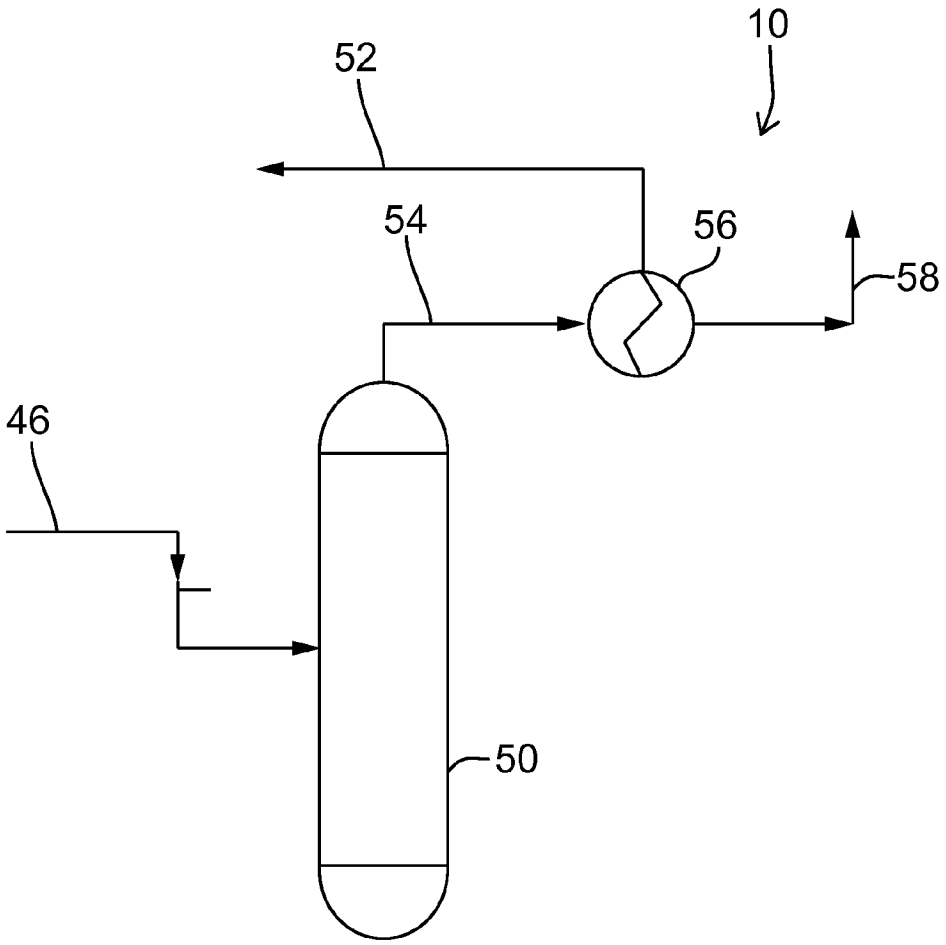

FIG. 3 is a schematic diagram showing the separator area of hydrotreater 10. FIG. 3 shows hot separator 50. Liquid quench 52 is cooled in heat exchanger 56 prior to being recycled. Stripper product 58 is collected from separator 50.

FIG. 4 is a performance chart showing actual results of the quenching of this invention. Expectations were to be able to run 46M BPD at 10 ppm sulfur product with a 26API feedstock and 26MPBD (57%) cracked distillates. We've actually been able to run 54M BPD (now 57 MBPD) average at 6 ppm sulfur with a feed 0.5AP lower with 37 M BPD cracked distillates (68%).

FIG. 5 also is a performance chart showing actual results. More specifically, this chart shows running at lower sulfur amounts (6 ppm).

Figure 6:
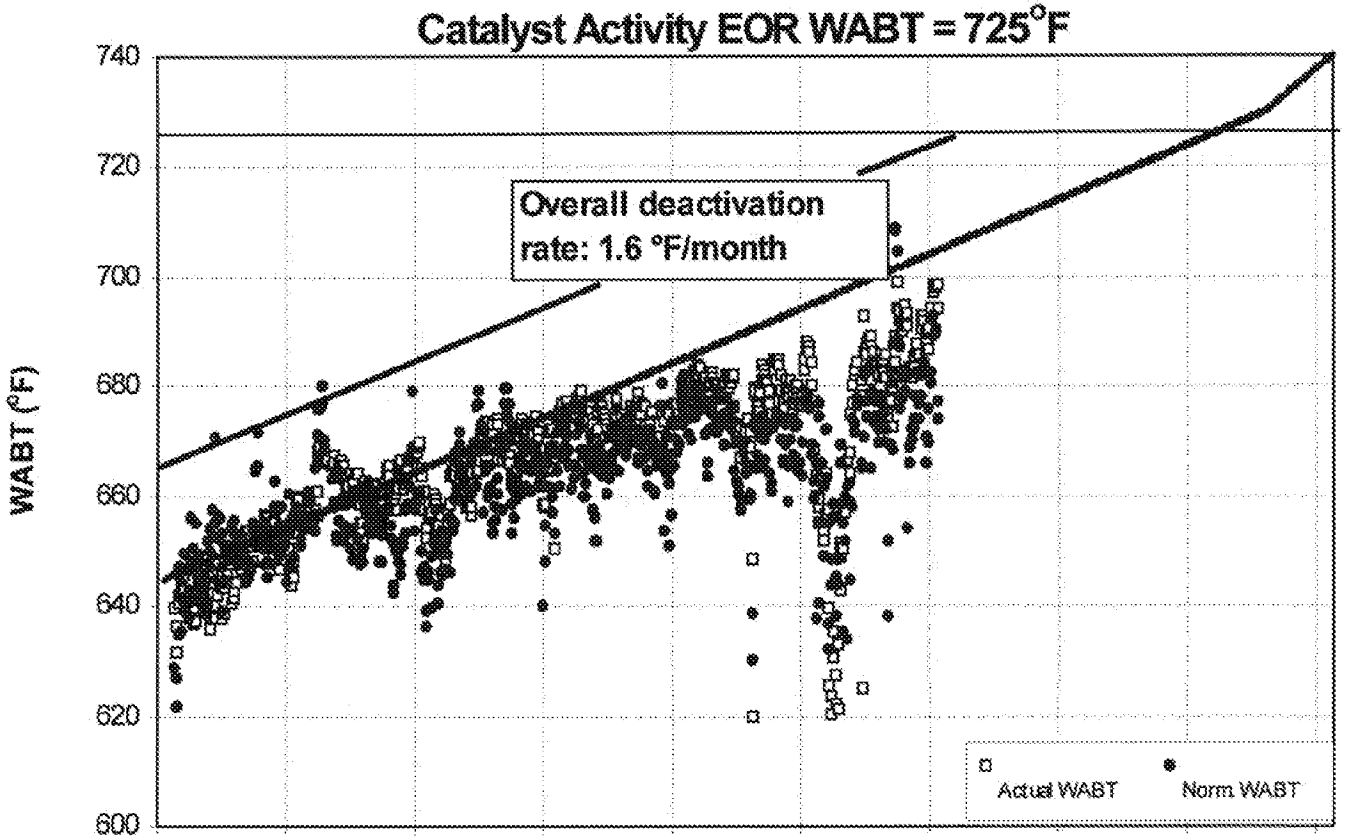
FIG. 6 is a graph showing actual results versus design results.

FIG. 6 is a graph showing actual results versus design expectations. Overall, heavier, more cracked feedstocks at higher rates for longer periods of time were achieved. This is a tremendous accomplishment. The green line in the chart is the planned design deactivation rate, and the dark blue line is actual.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A hydroprocessing method comprising the steps of:

(a) combining hydrogen and a feed to be treated to form a mixture thereof wherein the feed is a hydrocarbon feed containing sulfur contaminants and having an API gravity of 25.8-32.9;

(b) providing a reactor with a substantially packed bed of hydroprocessing catalyst;

(c) contacting the mixture with the packed bed in the reactor;

(d) simultaneously injecting a liquid quench into the substantially packed bed of hydroprocessing catalyst of the reactor;

(e) withdrawing treated feed from the reactor;

(f) feeding the treated feed from the reactor to a hot separator;

(g) withdrawing a slipstream from the hot separator;

(h) recycling a portion of the slipstream to the reactor as the liquid quench; and (i) collecting another portion of the slipstream as stripper product having a sulfur content of 10 ppm or lower from the hot separator;

wherein the packed bed of catalyst of the reactor further comprises two beds of catalyst and the liquid quench of step (d) is fed to the reactor between the two beds of catalyst.

2. A hydroprocessing method comprising the steps of:

(a) combining hydrogen and a feed to be treated to form a mixture thereof wherein the feed is a hydrocarbon feed containing sulfur contaminants and having an API gravity of 25.8-32.9;

(b) providing a first reactor with a substantially packed bed of hydroprocessing catalyst;

(c) contacting the mixture with the packed bed in the first reactor;

(d) simultaneously injecting a gas quench into the substantially packed bed of hydroprocessing catalyst;

wherein the packed bed of catalyst of the first reactor further comprises two beds of catalyst and the gas quench is fed to the first reactor between the two beds of catalyst;

(e) withdrawing treated feed from the first reactor;

(f) combining the treated feed from the first reactor with a liquid quench to form a second mixture;

(g) providing a second reactor with a substantially packed bed of hydroprocessing catalyst;

(h) contacting the second mixture with the packed bed in the second reactor;

wherein the packed bed of catalyst of the second reactor further comprises two beds of catalyst and the second mixture is fed to the second reactor between the two beds of catalyst;

(i) withdrawing treated feed from the second reactor;

(j) feeding the treated feed from the second reactor to a hot separator;

(k) withdrawing a slipstream from the hot separator;

(l) recycling a portion of the slipstream to the second reactor as a liquid quench;

(m) collecting another portion of the slipstream as stripper product having a sulfur content of 10 ppm or lower from the hot separator; and (n) combining the second mixture with the gas quench from the slipstream prior to feeding the second mixture to the second reactor.

3. A hydroprocessing method comprising the steps of:

(a) combining hydrogen and a feed to be treated to form a mixture thereof wherein the feed is a hydrocarbon feed containing sulfur contaminants and having an API gravity of 25.8-32.9;

(b) providing a reactor with a substantially packed bed of hydroprocessing catalyst;

(c) contacting the mixture with the packed bed in the reactor;

(d) simultaneously injecting a liquid quench into the substantially packed bed of hydroprocessing catalyst of the reactor;

(e) withdrawing treated feed from the reactor;

(f) feeding the treated feed from the reactor to a hot separator;

(g) withdrawing a slipstream from the hot separator;

(h) recycling a portion of the slipstream to the reactor as the liquid quench; and (i) collecting another portion of the slipstream as stripper product having a sulfur content of 6-10 ppm from the hot separator;

wherein the packed bed of catalyst of the reactor further comprises two beds of catalyst and the liquid quench of step (d) is fed to the reactor between the two beds of catalyst.

4. A hydroprocessing method comprising the steps of:

(a) combining hydrogen and a feed to be treated to form a mixture thereof wherein the feed is a hydrocarbon feed containing sulfur contaminants and having an API gravity of 25.8-32.9;

(b) providing a first reactor with a substantially packed bed of hydroprocessing catalyst;

(c) contacting the mixture with the packed bed in the first reactor;

(d) simultaneously injecting a gas quench into the substantially packed bed of hydroprocessing catalyst;

wherein the packed bed of catalyst of the first reactor further comprises two beds of catalyst and the gas quench is fed to the first reactor between the two beds of catalyst;

(e) withdrawing treated feed from the first reactor;

(f) combining the treated feed from the first reactor with a liquid quench to form a second mixture;

(g) providing a second reactor with a substantially packed bed of hydroprocessing catalyst;

(h) contacting the second mixture with the packed bed in the second reactor;

wherein the packed bed of catalyst of the second reactor further comprises two beds of catalyst and the second mixture is fed to the second reactor between the two beds of catalyst;

(i) withdrawing treated feed from the second reactor;

(j) feeding the treated feed from the second reactor to a hot separator;

(k) withdrawing a slipstream from the hot separator;

(l) recycling a portion of the slipstream to the second reactor as a liquid quench;

(m) collecting another portion of the slipstream as stripper product having a sulfur content of 6-10 ppm from the hot separator; and (n) combining the second mixture with the gas quench from the slipstream prior to feeding the second mixture to the second reactor.

5. A hydroprocessing method comprising the steps of:

(a) combining hydrogen and a feed to be treated to form a mixture thereof wherein the feed is a hydrocarbon feed containing sulfur contaminants and having an API gravity of 25.8-32.9;

(b) providing a reactor with a substantially packed bed of hydroprocessing catalyst;

(c) contacting the mixture with the packed bed in the reactor;

(d) simultaneously injecting a liquid quench into the substantially packed bed of hydroprocessing catalyst of the reactor;

(e) withdrawing treated feed from the reactor;

(f) feeding the treated feed from the reactor to a hot separator;

(g) withdrawing a slipstream from the hot separator;

(h) recycling a portion of the slipstream to the reactor as the liquid quench; and (i) collecting another portion of the slipstream as stripper product having a sulfur content of 15 ppm or lower from the hot separator;

wherein the packed bed of catalyst of the reactor further comprises two beds of catalyst and the liquid quench of step (d) is fed to the reactor between the two beds of catalyst.

6. A hydroprocessing method comprising the steps of:

(a) combining hydrogen and a feed to be treated to form a mixture thereof wherein the feed is a hydrocarbon feed containing sulfur contaminants and having an API gravity of 25.8-32.9;

(b) providing a first reactor with a substantially packed bed of hydroprocessing catalyst;

(c) contacting the mixture with the packed bed in the first reactor;

(d) simultaneously injecting a gas quench into the substantially packed bed of hydroprocessing catalyst;

wherein the packed bed of catalyst of the first reactor further comprises two beds of catalyst and the gas quench is fed to the first reactor between the two beds of catalyst;

(e) withdrawing treated feed from the first reactor;

(f) combining the treated feed from the first reactor with a liquid quench to form a second mixture;

(g) providing a second reactor with a substantially packed bed of hydroprocessing catalyst;

(h) contacting the second mixture with the packed bed in the second reactor;

wherein the packed bed of catalyst of the second reactor further comprises two beds of catalyst and the second mixture is fed to the second reactor between the two beds of catalyst;

(i) withdrawing treated feed from the second reactor;

(j) feeding the treated feed from the second reactor to a hot separator;

(k) withdrawing a slipstream from the hot separator;

(l) recycling a portion of the slipstream to the second reactor as a liquid quench;

(m) collecting another portion of the slipstream as stripper product having a sulfur content of 15 ppm or lower from the hot separator; and (n) combining the second mixture with the gas quench from the slipstream prior to feeding the second mixture to the second reactor.

* * * * *